United States Patent [19]

Evans et al.

[11] Patent Number: 5,076,220

[45] Date of Patent: Dec. 31, 1991

[54] INTERNAL COMBUSTION ENGINE

[75] Inventors: Hugh G. Evans, West 214 6th Ave., Spokane, Wash. 99204; Stephen Speer, Spokane, Wash.

[73] Assignee: Hugh G. Evans, Spokane, Wash.

[21] Appl. No.: 390,896

[22] Filed: Jul. 25, 1989

Related U.S. Application Data

[63] Continuation of Ser. No. 266,053, Oct. 13, 1988, abandoned, which is a continuation of Ser. No. 932,774, Nov. 19, 1986, abandoned, which is a continuation of Ser. No. 829,397, Mar. 13, 1986, abandoned, which is a continuation of Ser. No. 634,315, Jul. 24, 1984, abandoned, which is a continuation of Ser. No. 426,537, Sep. 29, 1982, abandoned, which is a continuation of Ser. No. 212,093, Dec. 2, 1980, abandoned.

[51] Int. Cl.[5] ..... F02B 75/06

[52] U.S. Cl. ..... 123/65 VC; 123/90.31; 123/197.4

[58] Field of Search ..... 123/54 R, 54 B, 65 VC, 123/70 R, 90.31, 193 R, 193 P, 197 R, 197 A, 197 AB, 197 AC

[56] References Cited

U.S. PATENT DOCUMENTS

| | | | |
|---|---|---|---|
| 792,615 | 6/1905 | Ramsey | 123/54 R |
| 1,318,471 | 10/1919 | Amonsen | 123/54 B |
| 1,384,343 | 7/1921 | Powell | 123/54 R |
| 1,515,946 | 11/1924 | Giles | 123/197 R |
| 2,048,223 | 7/1936 | Scott | 123/65 VB |
| 2,368,412 | 1/1945 | Cords | 123/197 AB |
| 2,575,633 | 11/1951 | Lugt | 123/70 R |
| 4,131,096 | 12/1978 | Mitchell | 123/90.3 |
| 4,167,160 | 9/1979 | Matsushita et al. | 123/73 R |
| 4,628,876 | 12/1986 | Fujikawa et al. | 123/192 B |

FOREIGN PATENT DOCUMENTS

| | | | |
|---|---|---|---|
| 2593232 | 7/1987 | France | 123/197 R |
| 0375116 | 6/1932 | United Kingdom . | |

*Primary Examiner*—David A. Okonsky

*Attorney, Agent, or Firm*—Barry G. Magidoff

[57] ABSTRACT

In an internal combustion engine wherein the air inlet ports are opened and closed directly by the reciprocating movement of the piston, the crankshaft is laterally offset from the central plane common to the longitudinal axes of all of the cylinders. This results in a substantial increase in the power output of the engine.

15 Claims, 4 Drawing Sheets

FIG. 4
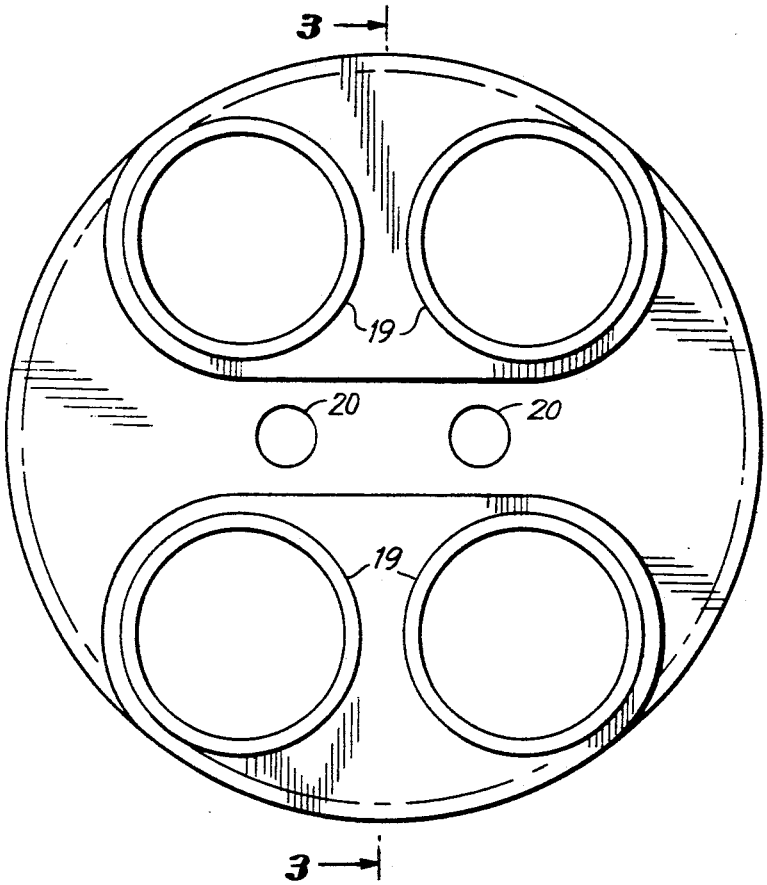
FIG. 5
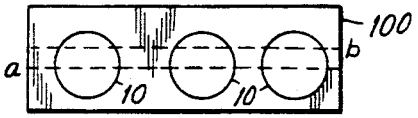
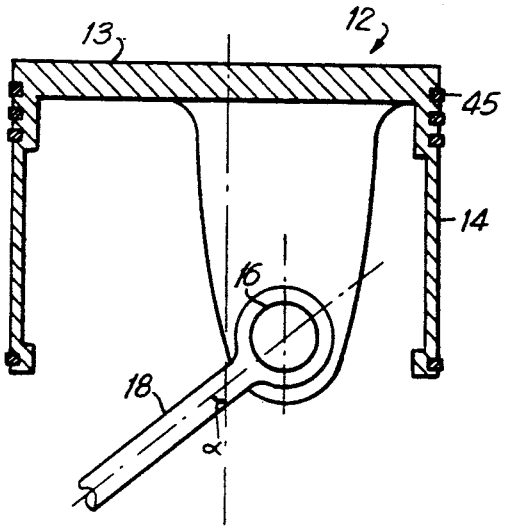
FIG. 6

INTERNAL COMBUSTION ENGINE

This is a continuation of application Ser. No. 266,053, filed Oct. 13, 1988, now abandoned, which is a continuation of application Ser. No. 932,774, filed Nov. 19, 1986, now abandoned, which is a continuation of application Ser. No. 829,397, filed Mar. 13, 1986, now abandoned, which is a continuation of application Ser. No. 634,315, filed July 24, 1984, now abandoned, which is a continuation of application Ser. No. 426,537, filed Sept. 29, 1982, now abandoned, which is a continuation of application Ser. No. 212,093, filed Dec. 2, 1980, now abandoned.

This invention relates to improvements in internal combustion engines, and most especially relates to so-called two-cycle engines.

The history of the development of internal combustion engines has a continuing theme: the provision of an engine having the greatest possible horsepower for a given size and weight, while optimizing the durability and reliability of the engine.

In the past, the two requirements set forth above have had an almost inverse relationship. The power output of an engine, which is directly related to the total mass flowthrough of the engine, for a given volume of engine, could be increased, e.g. by either increasing the pressure applied to the working fluid or by increasing the speed of the engine, whereby the number of cycles per unit time was increased. Both of these conditions tended to increase the stress applied to the engine components, thus generally requiring a significant equivalent increase in the weight of the engine; and also increasing engine speed, especially, often resulted in a more complex engine.

For example, increasing the pressure, clearly requires thicker engine walls and also places a greater strain on all engine components. This of necessity requires either a significantly larger engine, and certainly a heaver engine, and also increases the likelihood of failure of the engine, especially caused by a failure of maintaining engine seal, especially, for example, around the valves and between the moving piston and the cylinder wall.

An increase in engine speed, especially on the two-cycle engine, required an increase in the timing differential, or of the effective height of the working fluid inlet port into the engine cylinder. This increase in effective height has been obtained, for example, by providing a movable sleeve valve, located between the piston and the cylinder wall. The sleeve can be moved separately from the piston, albeit being ultimately driven by the power provided through the piston. Such a sleeve valve engine is shown, for example, in U.S. Pat. No. 1,956,804 to Meyer, wherein a single sleeve valve on the spark-ignited engine is provided with a combined reciprocating and oscillating movement relative to the cylinder and sleeve axes by means of a wobble valve shaft, ultimately driven from the engine crankshaft. In order to provide space for the wobble valve shaft, and also coincidentally to reduce piston slap, the crankshaft is offset to one side of the central longitudinal plane of the engine cylinders, in the direction of the crankshaft rotation.

Offsetting of the crankshaft is also shown in U.S. Pat. No. 2,315,114, to Fels and U.S. Pat. No. 2,392,921 to Holman, both of these latter two patents utilize a segmented piston-connecting rod involving a pivoted intermediate joint between the piston rod and the crankshaft.

In the case of Holman, there are two crankshafts offset on either side of the central plane of the cylinder which rotate in opposite directions. In each case, the crankshaft is offset in the direction of rotation of the crankshaft. Fels utilizes an intermediate rocker arm between the crankshaft and the piston connecting rod in order to maintain a more nearly constant torque delivery during the engine cycle.

In accordance with the present invention, a two-cycle engine can be operated efficiently at a higher engine speed by increasing the period during which the inlet ports are open during each cycle. To this end, the crankshaft is offset laterally from a common plane including the longitudinal axis of each cylinder. To obtain the desired result, crankshaft rotation is in a direction opposite that of the direction of the off-set. When reference is made to the direction of rotation of the crankshaft, this refers to the lateral direction of movement of the crankshaft, when it is considered as rotating with a crank moving downwardly.

Although this invention is applicable to internal combustion engines used for any purpose, the result of decreased weight and size, as well as a decrease in complexity, is clearly most important for engines used in powering aircraft. For such purpose, any substantial increase in size or weight will have a far greater effect than for the powering of most surface vessels.

A further understanding of the present invention can be obtained by reference to the preferred embodiments set forth in the illustrations of the accompanying drawings. The illustrated embodiment, however, is merely exemplary of certain presently known preferred systems for carrying out the present invention. The drawings are not intended to limit the scope of this invention, but merely to clarify and exemplify, without being exclusive thereof.

Referring to the drawings:

FIG. 4 is a top plan view of the cylinder of FIG. 3;

FIG. 5 is a plan view of the three-cylinder engine illustrated; and

FIG. 6 is a cross-section through a piston showing a further embodiment of this invention.

Figure 1:
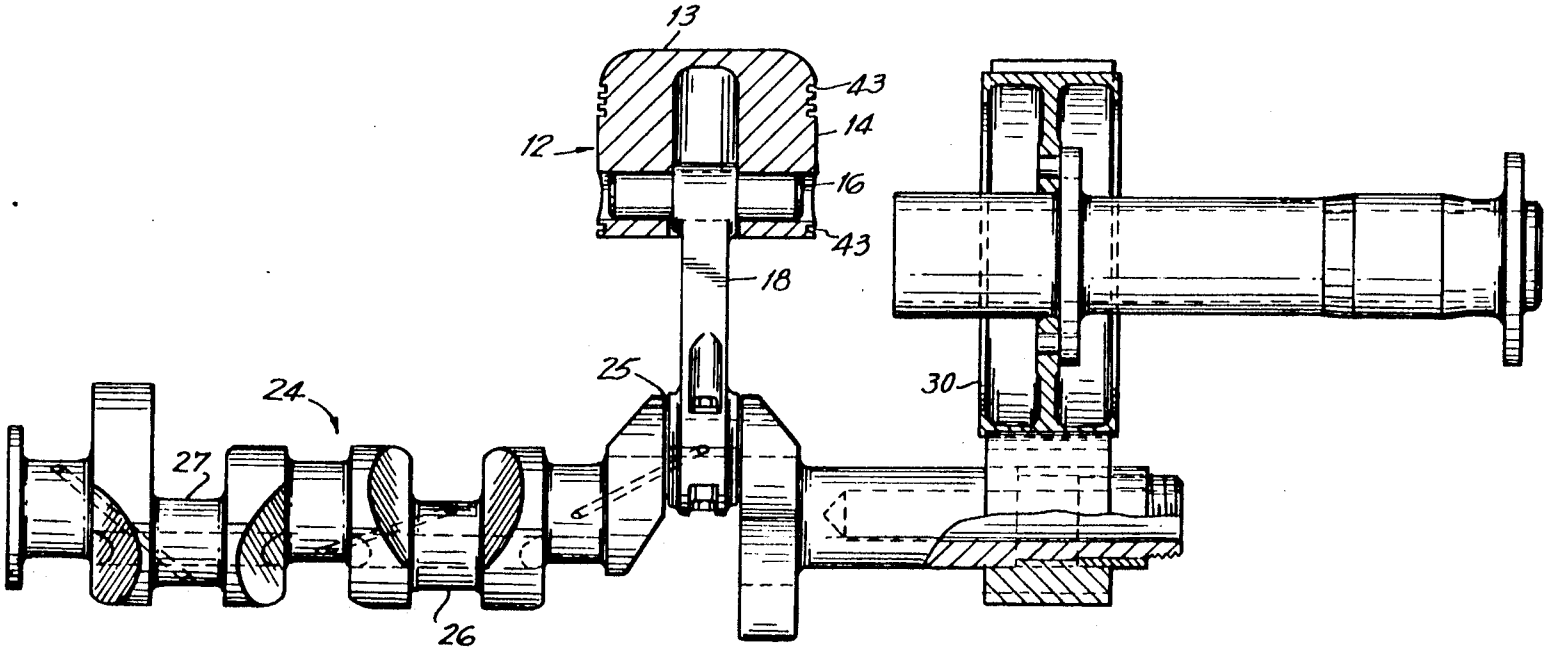
FIG. 1 is a side elevation view of the crankshaft of a three-cylinder engine according to this invention, with attendant reduction gears and showing one of the pistons attached to the crankshaft.

Since most portions of the engine utilizing the present invention can be of conventional construction, except for the significant advantages of decreased size and weight for given power output obtainable by the present invention, it is believed to be sufficient to illustrate only those portions set forth herein; these includes a cross-section of a single cylinder, with the connecting rod and crankshaft connections being only diagrammatically shown. The invention deals primarily with the relationship of these parts to each other and not to any specific structural features. The engine shown is of the two-cycle diesel type, although this is merely exemplary and the invention is equally adaptable to a spark ignition engine, or even other modes or type of engine power cycles possible with reciprocating piston engines, that can function with an inlet port located through the side wall of the cylinder that is alternately opened and closed directly by the movement of the piston.

As shown in the drawings, the cylinder, generally indicated by the numeral 10, has a piston 12 reciprocally movable therewithin. The piston 12 includes a relatively thick head portion 13 and skirt 14 extending outwardly therefrom. A wrist pin 16 is mounted within the skirt 14 at a location adjacent the outer end thereof. A piston connecting rod 18 is journaled around the wrist pin 16, at the upper end of the connecting rod 18. The piston head 13, as depicted in the drawing, presents a substantially convex surface, which is conventionally used for diesel engines. Similarly, a flat head surface could be provided if the engine were to be used in a spark ignition cycle. Other configurations can be utilized, which are well known in the art, or which may be developed in the future, without affecting the present invention. In the upper end of the cylinder 10, four exhaust valves 19, of the poppet-type, are provided, which are operated by a cam shaft not explicitly shown in the drawings. Openings for two fuel injectors, defined by surfaces 20, are provided in this preferred embodiment. This invention is not limited, however, to any particular combustion chamber design, e.g. the combination of valves, fuel inlets, and spark plugs, if any are used.

The in-line, two-cycle engine depicted in the drawings is shown as having three cylinders in accordance with FIG. 1. It must be understood that this number is not limiting and either a smaller or greater number of cylinders can be present in any operating engine in accordance with this invention. The crankshaft in all cases is located such that its longitudinal axis is parallel to but laterally offset to a substantial extent from, the common plane extending longitudinally of the cylinder block and including the longitudinal axis of each cylinder in the block. The crankshaft, generally indicated by the numeral 24, is designed for a three-cylinder engine and thus includes three cranks 25, 26 and 27, which are separated from each other by the same distances as separate the center lines of the cylinders, and are angularly spaced apart about the circumference of the crankshaft, 120 degrees. As is shown in FIG. 1, the crank 25 is journaled within the second end of the connecting rod 18.

Figure 2:
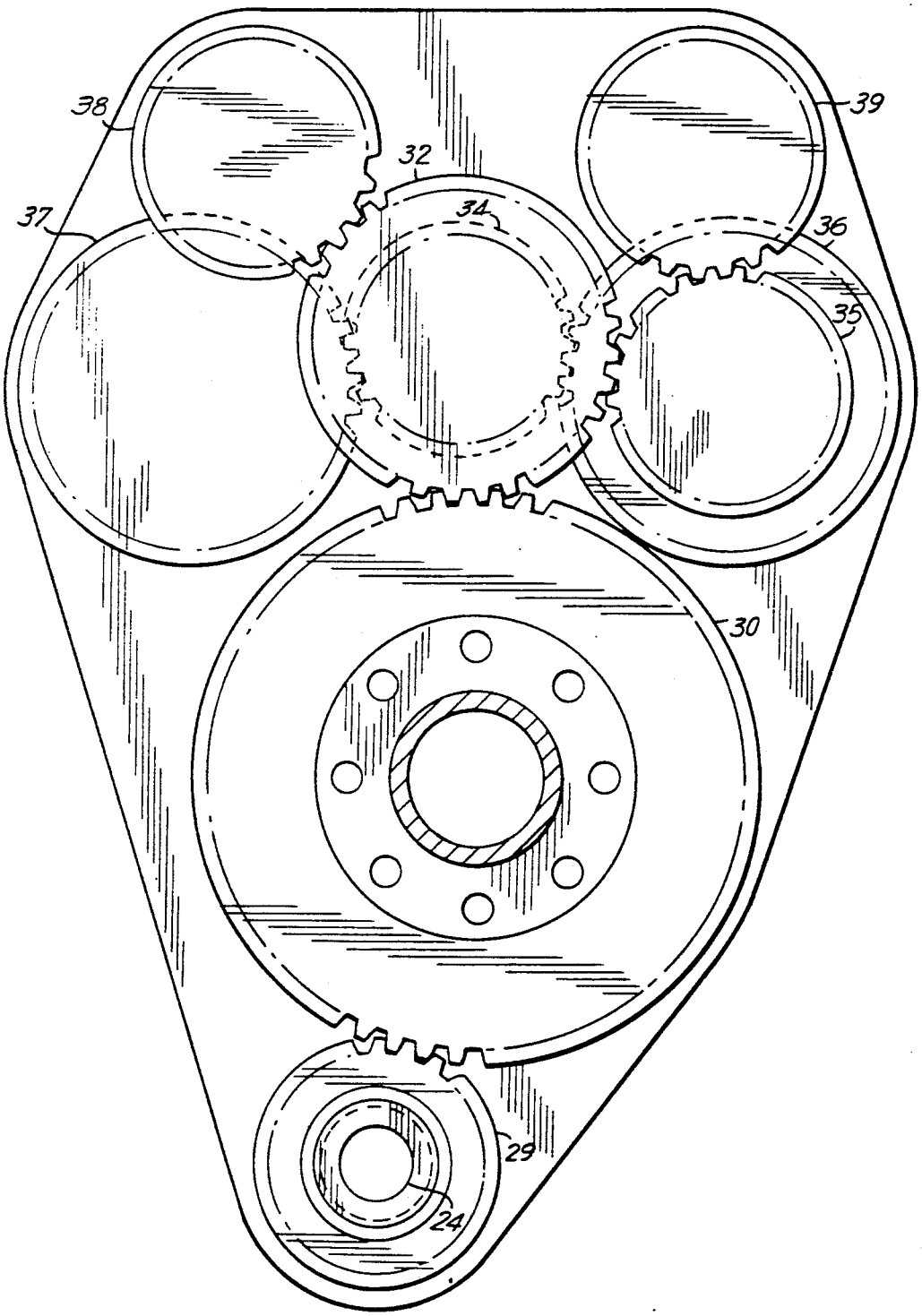
FIG. 2 is a front elevation view showing the forward end of the crankshaft and main drive, together with the attendant reduction gears of the engine of FIG. 1.

The crank 24 operates the exhaust poppet valves and the various other accessories which may be utilized with this engine, such as for example an air turbocharger, through the reduction gears shown in FIG. 2. The main drive 30, driven by the pinion gear 29, connects to the main cam drive gear 32 which, in turn, is connected by conventional means to the other camming gears including the right cam gear 38 and accessory gear 34, the left cam idler 35, the left accessory drive 36, the right accessory drive 37, the right cam gear 38, and the left cam gear 39. The shaft connections between these various gears and the exhaust valves or accessories are not shown here but are conventional in the art, not having a direct effect on the present invention. It is useful to note, however, that preferred mechanical operating charateristics are obtained when the axis about which the main drive 30 rotates, passes through the common longitudinal plane of the cylinders in the piston block.

In the particular embodiment shown herein, each cylinder 10 is formed within a cylinder block 100, as by casting, there being a water jacket defined between the internal surfaces of the engine block 100 and the external surfaces of the individual cylinders 10. Air inlet ports defined by lateral surfaces 40 are formed in the middle area of each cylinder 10, below the water jacket 10. A sleeve liner 42 is press fit into the cylinder bore, so as to remain stationary during engine operation. This sleeve 42 can also be cast in place or the interior surface of the cylinder wall can be suitable finished so that the piston rides directly on the cylinder 10. The cylinder liner 42 includes ports defined by lateral surfaces 43, the ports 43 being so located on the sleeve such that when the sleeve is slip fit within the cylinder 10, each port 43 is aligned with a complementary port 40 through the cylinder wall 41. The internal circumferential surface of the cylinder liner 42 is so sized as to form a pressure-tight fit with the external circumferential surface of the piston skirt 14 during operation, and most specifically with the sealing rings 45 located circumferentially about the piston skirt 14.

Figure 3:
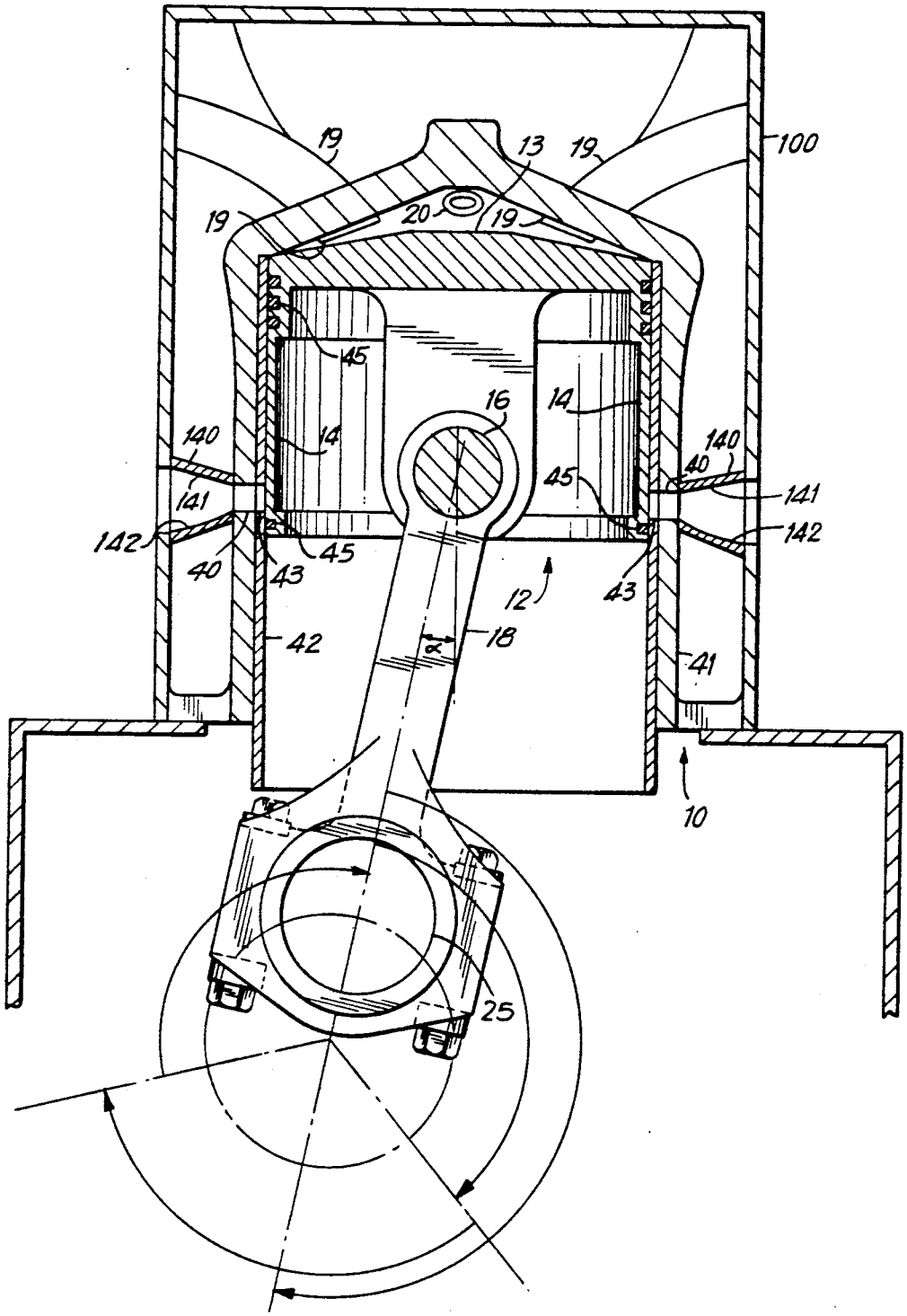
FIG. 3 is a transverse section through a cylinder and crankshaft of a two-cycle engine of the type of FIG. 1.

The inlet ports 40 (approximately 10 ports) are arranged about the circumference of each cylinder symmetrically relative to the common plane of the engine. Each port 40 is open between the cylinder 10 and an inlet plenum defined by the lower wall 140 of the water jacket 100 and the curved surface 142. The substantially straight surface 141 and curved surface 142 are convergent such that the inlet plenum has a venturi-like cross-section, as shown in FIG. 3.

The invention as embodied in the above-described engine, allows greater engine speed (rpm) and efficiency in operation by providing asymmetrical timing for the opening of the air inlet ports 40, 43, and increased effective port height for greater flow area cross-section, and, therefore, greater mass flow. A great advantage is obtained by the increased delay in the opening of the exhaust valve during each cycle, made possible by the offsetting of the crankshaft. This increases the period of expansion during each cycle of the engine, resulting in improved mechanical and thermodynamic efficiency.

Referring to the depicted engine, during operation, each piston 12 reciprocates within a cylinder 10, alternately opening and closing the air inlet ports 40, 43. The greater the amount of air, i.e., the engine working fluid, that can be drawn in during each cycle, the greater will be the effective power output of the engine, at a given engine speed, or cycle time. The present invention permits an increase in the intake of air per operating cycle of the engine by increasing the expansion period during each cycle. This is accomplished by permitting an increase in the height of the ports 40, 43, i.e., the distance parallel to the center line of the cylinder as shown in FIG. 3, and by increasing the period of time during which the port is open during each cycle of the engine. The length of the stroke of the crankshaft is effectively increased by its lateral offset relative to the center line of the cylinder. Thus, the greater the degree of offset the greater the effective increase in working fluid mass flow rate and thus the greater the increase in power output. Preferably, in order to gain a substantial advantage from the offset, the offset distance should be at least equal to about 10 percent of the radius of the piston, and optimally at least about 20 percent of the radius.

The effectiveness of the offset is assumed to be proportional to the size of the offset angle ($\alpha$). This angle $\alpha$ is maximized by maintaining the length of the connecting rod, i.e., the distance between the wrist pin 16 axis and the crank axis 25, 27, as short as possible. This can be shortened, e.g., by placing the wrist pin 16 axially outwardly from the piston head 13, i.e., as close to the outer end of the skirt 14 as is possible without mechanically interfering with the operation of the crankshaft at bottom dead center (as shown in FIGS. 3 and 6).

The angle $\alpha$ can be further increased by radially offsetting the pivoting connection between the piston and the connecting rod, e.g., wrist pin 16, in the direction opposite from the offset direction of the crankshaft (as shown in FIG. 6).

The effectiveness of the present invention can perhaps best be seen from the following specific example of an operating engine. In the three-cylinder, in-line, two-cycle, engine shown in the accompanying drawings, especially including FIG. 6, the cylinder liner, or sleeve 42, has a bore diameter of 5⅛ inches, the piston stroke length is increased to about 3-7/16 inches and the air intake port height is about 11/16 inch. The length of the connecting rod, from the center axis of the piston wrist pin to the center axis of the crankshaft is approximately 6 inches. The lateral offset of the axis of the crankshaft to the right of the common longitudinal plane of the cylinders is about 1⅝ inches, i.e., approximately equal to ½ the stroke of the piston, and the lateral offset of the wrist pin 16 to the left of the common plane is about ½ inch. In this embodiment, the crankshaft rotates to the left, as is indicated by the curved arrows in FIG. 3. This provides an offset angle $\alpha$, i.e., between a line drawn from the center point of the piston wrist pin 16 to the longitudinal axis of the crankshaft 24 relative to the common longitudinal plane, (designated as $\alpha$ in FIG. 6) of about 14 degrees. If the wrist pin 16 is located on the axis of the piston, i.e., without any offset, $\alpha$ (in FIG. 3) would be 12 degrees, and the stroke 3.39 inches.

Assuming that a conventional engine of this size (i.e., without any offset of crankshaft or wrist pin) develops approximately 400 horsepower at 3200 rpm, offsetting the crankshaft and wrist pin so as to provide an offset angle of $\alpha = 14°$ where the piston 12 is at top dead center, results in an improvement of at least 15% in the power output, i.e., to at least about 460 horsepower, and a concomitant increase in the maximum engine speed, i.e., to at least about 4000 rpm.

The operating cycle of the engine, as defined above, provides for the air intake ports 40, 43 to be open, that is, not covered by the piston skirt 14, for a period of 117 degrees of the total cycle of the piston. That is, the piston drops to below the level of the intake port 128 degrees after top dead center (TDC) and does not close until 115 degrees before TDC, i.e., when the piston has returned moving upwardly above the level of the intake ports 40, 43. Because of the offset ($\alpha$) angle, the bottom dead center of the engine operation is 190 degrees after TDC. Accordingly, it is believed that the effective increase in the time during which the intake port is open is equal to approximately ½ of the angle $\alpha$ in each cycle.

It is believed that this invention is particularly adaptable to the so-called "square" or "over-square" engine design, that is, where the cylinder bore is equal to or larger than the piston stroke. Such engines provide a larger bore for a given volumetric capacity and thus are better able to accommodate the angled connecting rod without interference with its movement.

It must be noted that care must be taken to maintain the structural strength of the piston wrist pin connection when placing the wrist pin 16 axially outwardly from the piston head 13, as shown in FIGS. 3 and 6.

Although offsetting, laterally or axially, the wrist pin, as described above, can create structural problems with regard to the structural strength of the piston, a compromise of structural strength versus offset angle is among the parameters that must be taken into account in designing an engine in accordance with the present invention. Other factors, as stated above, are the length of the connecting rod 18, the diameter of the connecting rod 18, and the distance between the outer end of the piston skirt 14 and the crank 25, 27 and the outer end of the cylinder. Thus, although in conventional engines, the cylinder walls extend a substantial distance below bottom dead center of the piston, to avoid obstruction for the present invention, the cylinder side walls 42 should be made as short as possible; alternatively, indentations or notches can be formed in the cylinder wall extending axially to the bottom dead center position of the piston during operation, to eliminate as much as possible any mechanical interference with the angled connecting rod 18, without disturbing the pressure seal of the cylinder/piston interface.

Although a movable sleeve valve can be used to increase the air flow during operation of the piston, as compared to the simple port valve as shown in the accompanying drawings, the greater complexity of design of a sleeve valve is not required when the present invention is provided for a given engine design. It is critical that the crankshaft be offset in the direction opposite to the rotation of the crankshaft, in order to obtain the desirable asymmetrical port timing, which results in an increased open, or intake, period for the intake ports. Offsetting the crankshaft in the same direction as the rotation of the crankshaft, will not have this effect, and in fact should have the diametrically opposite effect of reducing the period of time during which the port is open.

In operating an engine in accordance with this invention, air can be pressurized, i.e., supercharged, prior to the intake into the engine, by means that are well known to the art. Such a pressurizer, or supercharger, can be operated by, for example, the accessory gears as defined above. However, any type of supercharger, or intake air pressurizing means, can be used: exhaust gas driven turbochargers or so-called comprex, or pulsed, superchargers.

Similarly, fuel, i.e., petroleum hydrocarbons, can be fed into the engine by any of a variety of known methods. For example, when operating a spark-ignited engine, the fuel can be fed either by a conventional carburetor or by a conventional fuel injector, both of which are well known to the art, or improvements or modifications thereof which may be developed in the future. For a diesel engine, the conventional means for feeding fuel is by use of a fuel injection system; however, again, other presently known means or other means which may in the future be developed can be utilized.

The patentable embodiments of this invention which are claimed are as follows:

1. In a 2-cycle, diesel cycle internal combustion engine comprising a single in-line engine block, internal wall surfaces defining at least one cylinder within the engine block, the central longitudinal axis of each cylinder being within a common plane extending longitudinally of the engine block, the axially extending internal wall surface to each cylinder being closed at one end and having at least one air intake port therethrough, a piston axially and reciprocally movable within each cylinder over a permitted stroke distance, so as to alternately cover and expose each air intake port for a finite time period; an exhaust port at the closed end of the cylinder above the piston, and a mechanically operated valve for opening and closing such exhaust port located immediately adjacent such port, a substantially rigid connecting rod pivotably connected at one end of each piston, and a crankshaft, rotatably connected to the second end of each connecting rod, such that the crankshaft is caused to rotate by reciprocating movement of each piston, and a rotatable connecting means between the piston and the connecting rod, the improvement wherein the diameter of the cylinder is greater than the permitted stroke distance of the piston within the cylinder, and the axis of the crankshaft is parallel to and laterally offset from the common plane by a distance sufficient to form an angle alpha between the connecting rod and the axis of the cylinder, when the piston is at top-dead center, of at least about 12 degrees, such that the time during which each air intake port is exposed is increased when the direction of crankshaft rotation is opposite to the direction of the crankshaft offset from the common plane.

2. The internal combustion engine of claim 1, comprising at least two cylinders and two pistons.

3. The internal combustion engine of claim 1, comprising a convergent plenum in fluid flow connection between the ambient and each air intake port, the plenum being convergent towards each port.

4. The engine of claim 1, comprising a plurality of substantially identical cylinders within the engine block; a plurality of pistons, one piston axially, reciprocally movable within each cylinder in a cyclical movement; a plurality of rigid connecting rods between each said piston and the offset crankshaft, the crankshaft being a single unitary rigid member, having a single axis; a plurality of mechanical camming means, each camming means being operatively connected to the mechanically-operated valve in each cylinder; drive means, operatively connected between the single crankshaft and each of the mechanical camming means, for driving the camming means; the plurality of camming means being so arranged with respect to the valve and driving means, such that the exhaust port to each cylinder is opened at a predetermined point in time during the reciprocal movement of the piston within that cylinder, to exhaust gases from the cylinder, to a point which is relatively late in the cyclical movement of the piston, thereby increasing the expansion during each cycle of the reciprocating movement of each piston.

5. The engine of claim 1, further including fuel injection means located at the closed end of each cylinder.

6. The engine of claim 1, further including air compression means in fluid flow connection to the air intake port, to provide pressurized air to the cylinder.

7. The engine of claim 1, wherein the angle alpha formed between the connecting rod at the top dead center position of the piston and the longitudinal axis of the cylinder is equal to at least about 14 degrees.

8. In a 2-cycle, diesel cycle internal combustion engine comprising a single in-line engine block, internal wall surfaces defining at least one cylinder within the engine block, the central longitudinal axis of each cylinder being within a common plane extending longitudinally of the engine block, the axially extending internal wall surface to each cylinder being closed at one end and having at least one air intake port therethrough, a piston axially and reciprocally movable within each cylinder over a permitted stroke distance, so as to alternately cover and expose for a finite time period each air intake port; an exhaust port at the closed end of the cylinder above the piston and a mechanically operated valve for opening and closing such port located immediately adjacent such exhaust port, a substantially rigid connecting rod pivotably connected at one end to each piston, and a crankshaft, rotatably connected to the second end of each connecting rod, such that the crankshaft is caused to rotate by reciprocating movement of each piston, and a rotatable connecting means between the piston and the connecting rod, the improvement wherein the diameter of the cylinder is greater than the permitted stroke distance of the piston within the cylinder, and the axis of the crankshaft is parallel to and laterally offset from the common plane by a distance sufficient to increase by at least about 10 percent the time during which each inlet port is open during each cycle when the direction of crankshaft rotation is opposite to the direction of the crankshaft offset from the common plane.

9. In a 2-cycle, diesel cycle internal combustion engine comprising a single in-line engine block; an internal wall surface defining at least one cylinder, having one closed end, within the engine block, the longitudinal axis of each cylinder being aligned within the common plane extending longitudinally of the engine block, each axially extending internal wall surface having a plurality of air intake ports therethrough distributed around the circumference of the cylinder;

a piston having a head surface extending transversely across the cylinder, an axially extending circumferential skirt portion adjacent the internal wall surface and extending axially from the head surface in a direction away from the closed end of the cylinder, and at least one circumferential sealing surface secured to the skirt portion and in movable sealing relationship to the internal wall surface, the piston being axially and reciprocally movable within each cylinder so that the sealing surface alternately covers and exposes for a finite period of time each air intake port;

an exhaust port at the closed end of the cylinder; and a mechanically operated valve located immediately adjacent such port for opening and closing such port;

a substantially rigid connecting rod;

a rotatable connecting means pivotably connecting one end of the connecting rod to the piston; and a crankshaft, rotatably connected to the second end of the connecting rod, such that the crankshaft is caused to rotate by reciprocating movement of each piston, the axis of the crankshaft being parallel to and laterally offset from the common plane;

the improvement characterized by the engine being so designed that the diameter of the piston is greater than the permitted axial movement of the piston within the cylinder; the axis of the crankshaft being offset from the common plane by a distance such that the angle alpha formed between the longitudinal axis of each cylinder and a line drawn from the center point of the rotatable connection means to the axis of the crankshaft, at the top dead center position of the piston, is equal to at least about 12 degrees; and further wherein the rotatable connection means is adjacent a plane which is perpendicular to the axis, includes the sealing surface, and is located at a distance from the piston head surface, such that the period of time during which each air intake port is exposed is increased when the direction of crankshaft rotation is opposite to the direction of the crankshaft offset from the common plane.

10. The internal combustion engine of claim 9, wherein the piston comprises a piston head and a skirt portion extending axially outward from the piston head, and wherein the pivoting connection between the piston and the connecting rod is in a plane substantially perpendicular to the axis of the piston and located adjacent the skirt portion of the piston.

11. The engine of claim 9, wherein the connecting rod pivots in relation to the piston about an axis that is substantially parallel to, but laterally offset from the common plane in a direction opposite to the direction of offset of the crankshaft.

12. In the engine of claim 11, wherein the piston has a plurality of sealing surfaces, each sealing surface extending around the circumference of the skirt transversely to the cylinder axis, the several sealing surfaces being axially spaced away from the piston head surface towards the crankshaft, and wherein the rotatable connection is located on a plane adjacent the sealing surface spaced furthest from the piston head surface.

13. The engine of claim 9, comprising a plurality of substantially identical cylinders within the engine block, a plurality of pistons, one piston axially, reciprocally movable within each cylinder, a plurality of rigid connecting rods, one between each said piston and the offset crankshaft, the crankshaft being a single unitary rigid member, having a single axis, a plurality of mechanical camming means, one camming means being operatively connected to the mechanically-operated valve in each cylinder, drive means, operatively connected between the single crankshaft and each of the mechanical camming means, for driving the camming means, the plurality of camming means being so arranged with respect to the valve and the driving means such that the exhaust port to each cylinder is opened at a predetermined point in time during the reciprocal movement of the piston within that cylinder, to exhaust gasses from the cylinder, the point in time being relatively late in the cyclical movement of the piston, thereby increasing the period of expansion during each cycle of the reciprocating movement of each piston.

14. The engine of claim 13, further including fuel injection means located adjacent the closed end of each cylinder.

15. The engine of claim 14, further including air compression means in fluid flow connection to the air intake port, to provide pressurized air to the cylinder.

* * * * *